United States Patent [19]

Rosenthal

[11] Patent Number: 4,911,337

[45] Date of Patent: Mar. 27, 1990

[54] SNAP-ACTION CLOSURE WITH DISENGAGABLE SPRING HAVING STRESS RELIEVED POSITIONS

[75] Inventor: Karl-Heinz Rosenthal, Reichshof, Fed. Rep. of Germany

[73] Assignee: Bielsteiner Verschlubtechnik GmbH, Gummersbach, Fed. Rep. of Germany

[21] Appl. No.: 409,921

[22] Filed: Sep. 20, 1989

Related U.S. Application Data

[63] Continuation-in-part of Ser. No. 168,862, Mar. 16, 1988, abandoned.

[30] Foreign Application Priority Data

Nov. 13, 1987 [DE] Fed. Rep. of Germany ..... 3738682

[51] Int. Cl.[4] ..... B65D 43/14

[52] U.S. Cl. ..... 222/498; 220/335; 220/339; 222/517; 222/556

[58] Field of Search ..... 222/498, 517, 543, 556; 220/335, 339

[56] References Cited

U.S. PATENT DOCUMENTS

| | | | |
|---|---|---|---|
| 3,419,198 | 12/1968 | Pettersen | 222/543 X |
| 3,503,544 | 3/1970 | Setera | 222/556 |
| 4,124,151 | 11/1978 | Hazard | 222/498 |
| 4,209,114 | 6/1980 | Wilson et al. | 222/556 X |
| 4,457,458 | 7/1984 | Heinol | 222/556 X |
| 4,503,991 | 3/1985 | Joyce | 222/498 X |
| 4,607,768 | 8/1986 | Taber et al. | 222/498 X |
| 4,669,622 | 6/1987 | Bennett | 222/517 |

*Primary Examiner*—Kevin P. Shaver

*Attorney, Agent, or Firm*—Dressler, Goldsmith, Shore, Sutker & Milnamow, Ltd.

[57] ABSTRACT

A closure is provided for a container. The closure has a body for being mounted over the container opening and defines an orifice for communicating through the container opening with the container interior. The body also defines a pair of spaced-apart bearing cavities. A lid is mounted to the body with a pair of trunnions for each being received in one of the bearing cavities. A compression link member has first and second ends with the first end connected to the body and the second end pivotally connected to the lid at a location spaced from the trunnion axis. The bearing cavities are configured and located to provide a clearance at least on opposite sides of each trunnion when the compression link member is in the full open position and in the full closed position.

15 Claims, 3 Drawing Sheets

FIG. 1
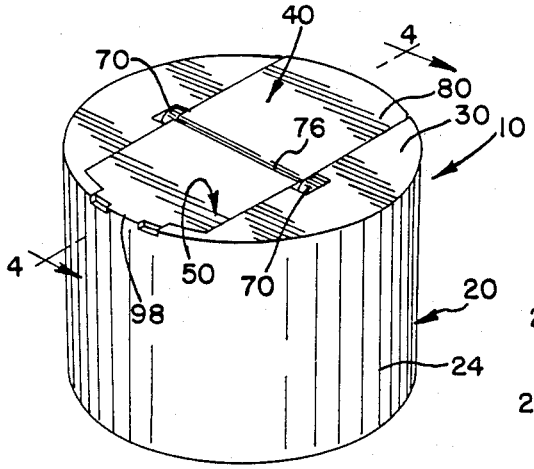
FIG. 3
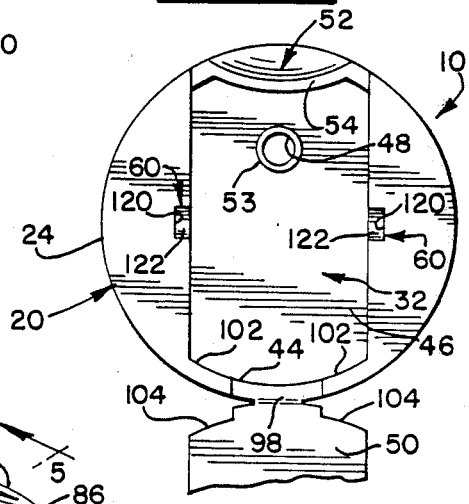
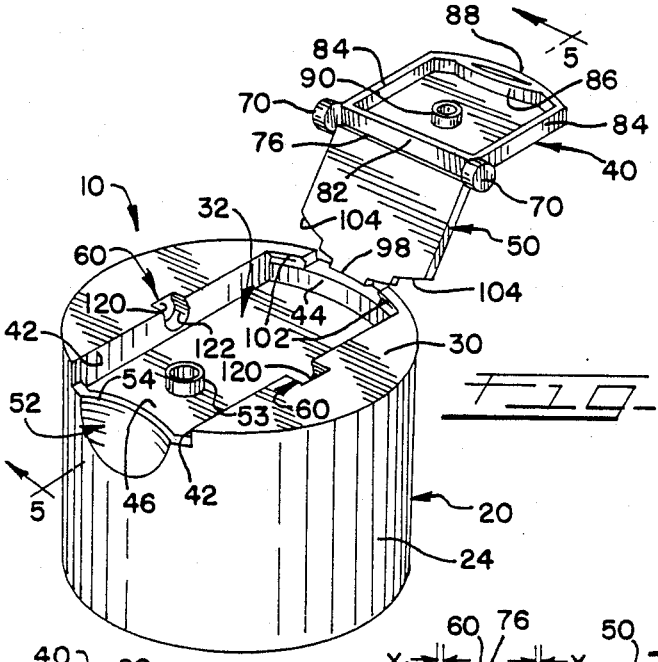
FIG. 2
FIG. 4
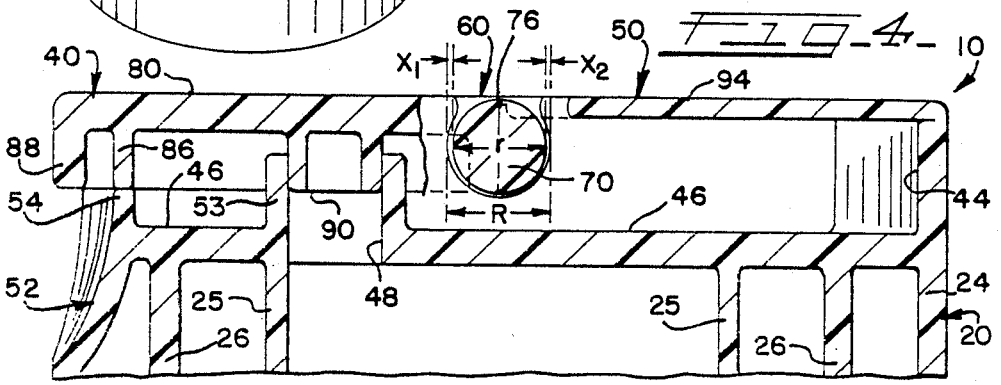

SNAP-ACTION CLOSURE WITH DISENGAGABLE SPRING HAVING STRESS RELIEVED POSITIONS

CROSS-REFERENCE TO RELATED APPLICATION

This is a continuation-in-part application of U.S. patent application Ser. No. 7/168,862 filed on Mar. 16, 1988, now abandoned.

TECHNICAL FIELD

This invention relates to a closure for use on the open end of a container from which fluid contents can be dispensed.

BACKGROUND OF THE INVENTION AND TECHNICAL PROBLEMS POSED BY THE PRIOR ART

A variety of closures have been proposed over the years for use with containers wherein the closure has a snap-action hinge for biasing the cover or lid to an open position on one side of an over center point and to a closed position on the other side of the over center point.

Some snap-action closure designs provide a one-piece unitary structure. While snap-action closures that have been used or proposed in the past may generally function well in the applications for which they were designed, it would be desirable to provide an improved one-piece unitary closure having a special inoperative orientation to accommodate molding and/or cleaning of the closure.

Further, it would be advantageous if such an improved closure could be provided wit a structure for permitting the closure to be fabricated with a generally smooth, planar top for certain applications where such a configuration would be desirable.

U.S. Pat. No. 4,124,151 discloses a low friction conical trunnion and bearing design in a snapaction closure having a spring-biased lid. The patent states that the closure lid spring structure is not held under any significant compression or tension when the lid is in either the open position or the closed position and, as a consequence, the structure will not take a "permanent set" as a result of being subjected to a pressure or force throughout a prolonged period. While such a closure design may result in lower stresses, it would be beneficial to provide a snapaction closure with an improved structural configuration that could accommodate manufacturing or molding tolerances so as to generally insure that the structure, if fabricated within those tolerances, would not be subjected to significant stresses in either the fully opened or fully closed positions of the lid.

SUMMARY OF THE INVENTION

A unitary dispensing closure is provided for use on a container that defines an opening communicating with the container interior.

The closure includes a body for being mounted to the container over the container opening and for defining a dispensing orifice for communicating through the container opening with the container interior.

The body defines a pair of spaced-apart bearing cavities, and a lid is provided with a pair of trunnions for each being received in one of the bearing cavities. The trunnions define an axis of rotation about which the lid can be pivoted through a range of movement defining at one end a fully closed position occluding the dispensing orifice and defining at the other end a fully open position spaced away from the dispensing orifice.

A compression line member is provided with first and second ends wherein the first end is connected to the closure body and the second end is pivotally connected to the lid at a location spaced from the trunnion axis. The compression link member is subjected to maximum stress when the lid is at an over center point between the fully open and fully closed positions. When the lid is on either side of the over center point, it is urged to a stable position at the end of its travel range on that side of the over center position.

The bearing cavities are configured and located on the closure body to provide a clearance at least on opposite sides of each trunnion when the compression link member is in the fully open position and in the fully closed position wherein the compression link member is substantially unstressed.

The clearance provided by this construction accommodates manufacturing and molding tolerances to insure that the compression link member is substantially unstressed in the fully open and fully closed positions.

The unique structure also permits the closure to be formed with a substantially smooth exterior surface, and is especially adapted for use in a closure having a generally flat top.

Further, the novel closure construction permits the closure to have an inoperative position for accommodating molding of the closure in one piece and for accommodating cleaning of the closure.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a perspective view of a first embodiment of the closure of the present invention shown with the lid in the fully closed position;

FIG. 2 is a perspective view of the closure of FIG. 1 rotated about 180 degrees from the orientation illustrated in FIG. 1 and showing the lid and compression link member in an inoperative orientation for facilitating cleaning of the closure;

FIG. 3 is a fragmentary, top plan view of the closure in the inoperative orientation shown in FIG. 2;

FIG. 4 is a greatly enlarged, fragmentary, cross-sectional view taken generally along he plane 4—4 in FIG. 1 with portions of the structure broken away to better illustrate interior detail;

DESCRIPTION OF THE PREFERRED EMBODIMENT

Figure 5:
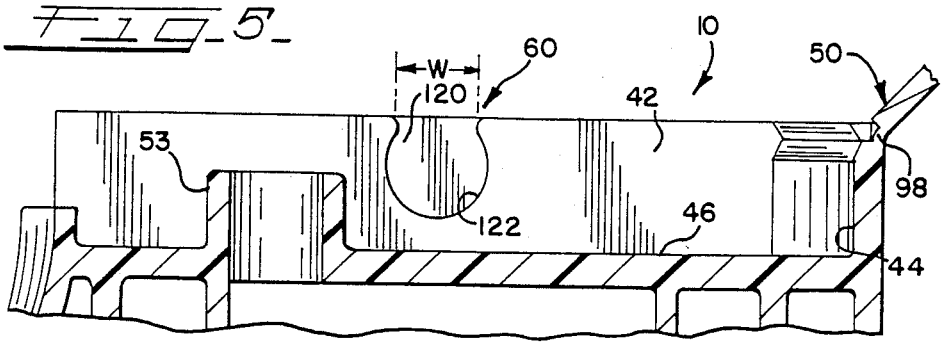
FIG. 5 is a greatly enlarged, fragmentary, cross-sectional view taken generally along the plane 4—4 in FIG. 2.

While this invention is susceptible of embodiment in many different forms, this specification and the accompanying drawings disclose only some specific forms as examples of the use of the invention. The invention is not intended to be limited to the embodiments so described, and the scope of the invention will be pointed out in the appended claims.

For ease of description, the closure of the invention is described in a position as it is usually encountered—upright on a container, and terms such as upper, lower, vertical, horizontal, etc. are used with reference to this position notwithstanding the fact that the container and closure may be used in other positions.

With reference now to the FIGURES, the closure of the present invention is represented generally by the numeral 10. The closure 10 is adapted to be disposed on a container (not illustrated), such as a container which has a conventional mouth or opening defined by a neck or other suitable structure. The closure 10 is preferably fabricated from a thermoplastic material or other suitable materials compatible with the container contents.

As best illustrated in FIGS. 1 and 2, the closure 10 includes a body 20 for placement on the container. In the illustrated embodiment, the body 20 includes a peripheral wall in the form of a cylindrical skirt or peripheral side wall 24.

As best illustrated in FIG. 4, the body 20 includes an internal sealing ring 25 which functions as a seal and protrudes into the interior of the container neck for engaging the inner peripheral surface of the neck so as to effect a tight seal.

Further, as best illustrated in FIG. 4, the closure also includes an internal mounting wall or walls 26 defining a suitable engaging means (e.g., a snap-fit bead or conventional thread (not illustrated)) for engaging suitable cooperating means on the container neck to releasably secure the body 20 to the container.

As best illustrated in FIG. 2, the closure body 20 includes a generally flat, disk-like deck or transverse top wall 30. The top wall 30 defines an elongate recess 32 for receiving a lid 40 and a compression link member 50 when the lid 40 is in the fully closed position (FIG. 1). The recess 32 is more specifically defined by a pair of opposed side walls 42, an arcuate rear wall 44, and a generally horizontal, planar bottom wall 46.

As best illustrated in FIG. 4, the bottom wall 46 defines a dispensing aperture 48. A cylindrical collar or spout 53 projects upwardly from the wall 46 around the dispensing aperture 48. At the front of the closure 10, the body skirt 24 has a recessed region 52 for accommodating a thumb, and the recessed region 52 extends upwardly on a short wall 54 above the upper surface of the recess bottom wall 46.

The closure body 20 also defines a pair of spaced-apart bearing cavities 60 for receiving a pair of trunnions 70 carried by, and projecting laterally from either side of, the lid 40.

The trunnions 70 are disposed at one end of the lid 40 adjacent a flexible film hinge 76 (FIGS. 1, 2, and 4) which connects the lid 40 to the compression link member 50 and which accommodates pivoting movement of the lid 40 and trunnions 70 about an axis defined by the trunnions 70 directly below the closed position of the film hinge 76.

The lid 40 includes a generally planar top wall 80, a rear wall 82, two spaced-apart side walls 84, and a front wall 86 having an outwardly projecting thumb lift potion 88. A generally cylindrical spud or plug 90 projects from the lid top wall 80 for being received in the collar 53 over the dispensing orifice 48. The lid side walls 84, rear wall 82, and front wall 86 are received within the recess 32 of the closure body 20. The bottom end of the front wall 86 abuts the top of the closure body all 54 when the lid 40 is in the fully closed position as illustrated in FIG. 4.

The compression link member 50 defines a planar top surface 94 which, when the lid 40 is in the fully closed position (FIG. 4), is generally coplanar with the upper surface of the lid top wall 80 and which is also coplanar with the film hinge 76. The plane defining the compression link member top surface 94 is tangent to each of the trunnions 70. The top surface of the lid top wall 80 and the top surface of the film hinge 76 are also each tangent to each of the trunnions 70.

As best illustrated in FIGS. 1, 2 and 3, the compression link member 50 is pivotally connected to the closure body 20 with a flexible film hinge 98 at the top edge of the periphery of the closure body skirt 24. On either side of the film hinge 98 the body 20 defines a pair of upstanding, spaced-apart abutment walls 102 which project upwardly from the rear wall 44 and define a portion of the recess 32 on either side of the film hinge 98.

Figure 7:
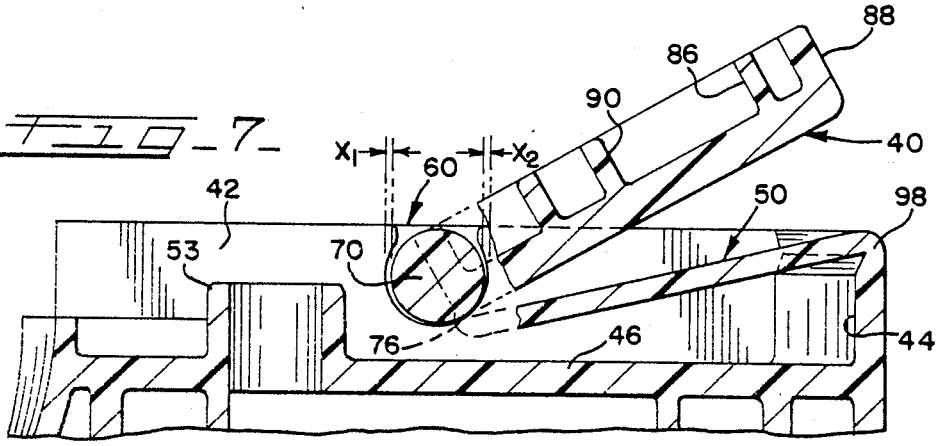
FIG. 7 is a view similar to FIG. 6 but showing the lid in the fully open position.

The compression link member 50 has a pair of spaced-apart end surfaces 104 on either side of the film hinge 98 for engaging the abutment walls 102 and imposing thrust loads thereon while the lid 40 is moved between a closed position (FIG. 1) and an open position (FIG. 7) when the compression link member 50 is in an operative position as illustrated in FIGS. 1 and 4. Preferably, each abutment wall 102 has an arcuate configuration at the periphery of the closure body 20. Each compression link member end surface 104 has an arcuate configuration substantially corresponding to the arcuate configuration of the opposing abutment wall 102

The closure 10 can be readily fabricated in an inoperative orientation wherein the compression link member 50 and lid 40 are positioned out of, and away from, the closure body recess 32 as shown in FIG. 2. The closure 10 may be molded with the link member 50 at somewhat of an angle relative to the closure body top wall 30 and to the lid 40. However, more preferably, the closure 10 would be molded with the link member 50 and lid 40 in a substantially coplanar orientation rotated about 180 degrees from the fully closed position.

The inoperative orientation of the closure 10, wherein the link member 50 and lid 40 are spaced from the recess 32, also defines a cleaning orientation which permits access to the recess 32 and to the dispensing aperture spout or collar 50 to facilitate cleaning of that region of the closure. Such cleaning may be necessary or desirable after the closure 10 has been used many times for dispensing a fluid from a container and some residue of the fluid has built up around the dispensing aperture spout 50 in the recess 32.

The novel structure of the trunnions 70 and bearing cavities 60 accommodates the manipulation of the closure parts to the inoperative, cleaning orientation and readily accommodates placement of the closure parts into the operative orientation from the inoperative orientation. Specifically, each bearing cavity 60 opens upwardly through the horizontal top wall 30 of the closure body 20 for receiving a trunnion 70. The closure body 20 is sufficiently resilient adjacent the opening to each bearing cavity 60 so that one of the trunnions 70 can be snapped through the opening into or out of the bearing cavity 60.

Preferably, as shown in FIG. 5, the opening to each bearing cavity 60 has a width W that is less than the diameter of the trunnion 70. Further, in a preferred form of the invention, each bearing cavity 60 is open on one side to the recess 32 but is defined on the other side by a generally flat, vertical, planar wall section 120 (FIGS. 2 and 5) of the closure body 20. Each cavity 60 is further defined by a bearing surface 122 which preferably has a partially cylindrical configuration.

When the closure 10 is in the operative orientation wherein the trunnions 70 are disposed within the bearing cavities 60 (FIGS. 1, 4, 6 and 7), the compression link member 50 is substantially unstressed so long as the lid 40 is in either the fully closed position or fully open position. Since the closure 10 is usually either fully open or fully closed, and is only temporarily in an intermediate position, the compression link member 50 is substantially unstressed during most of the life of the closure.

The substantial elimination of stresses on the compression link member 50 when the lid 40 is in the fully open and fully closed positions is achieved with the novel configuration of the link member 50, trunnions 70, and bearing cavities 60. Specifically, as best illustrated in FIG. 4, a portion of each bearing cavity 60 is wider than the trunnion 70 received therein. With respect to the specific preferred embodiment illustrated in FIGS. 1–7, the bearing cavity diameter R is slightly greater than the diameter r of the trunnion 70. The length of the compression link member 50 is selected so that the trunnion 70 is disposed within the cavity 60 with a clearance on either side. As illustrated in FIG. 4, when the lid 40 is in the fully closed position, a clearance $X_1$ is provided on the front side of each trunnion 70, and a clearance $X_2$ is provided on the rear side of each trunnion 70. Preferably, the magnitude of the clearance of $X_1$ is substantially equal to the magnitude of the clearance $X_2$.

Figure 6:
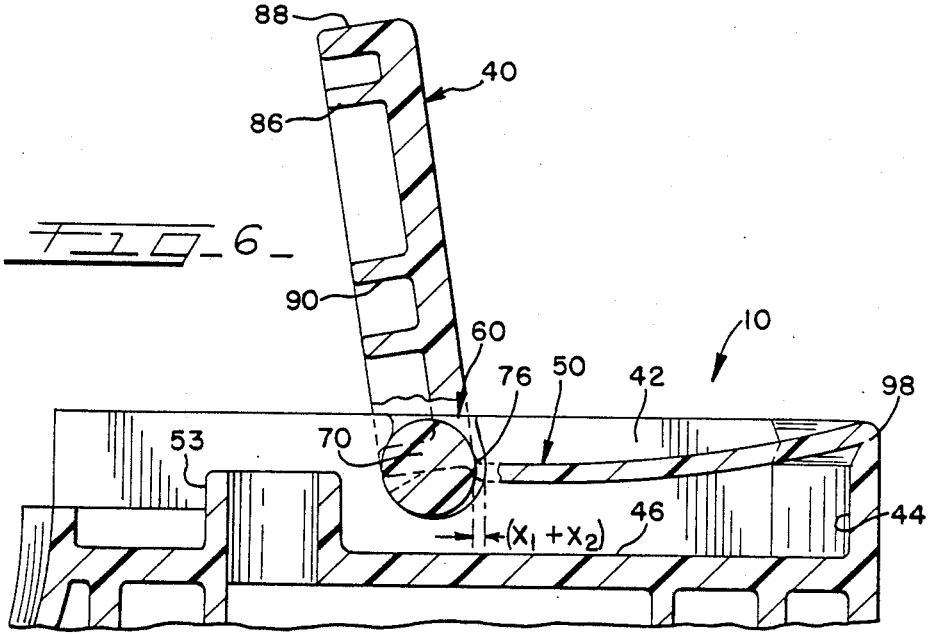
FIG. 6 is a view similar to FIG. 4 but showing the lid open to the over center point.

When the lid 40 is moved from the fully closed position (FIG. 4) toward the fully open position (FIG. 7), the lid 40 passes through an over center point (FIG. 6) at which the link 50 is subjected to a maximum compression stress. In particular, as the lid 40 is pivoted upwardly and as the trunnions 70 rotate in the bearing cavities 60, the film hinge 76 is carried clockwise rom the top position (as shown in FIG. 4) toward the body rear wall 44 (as shown in FIG. 6). The trunnions 70 are pivoted forwardly about the film hinge 76 against the fronts of the bearing cavities 60. The original clearance $X_1$ is thus eliminated at the front sides of the trunnions 70, and the clearance on the opposite rear sides of the trunnions 70 increases by the clearance amount $X_1$ to provide a total clearance amount equal to the sum of the original front and rear side clearances $X_1$ and $X_2$.

When the trunnions 70 have engaged the front sides of the bearing cavities 60, further rotation of the lid 40 toward the open position tends to move the front end of the compression link member 50 (connected through film hinge 76 to the lid 40) further clockwise to the over center position shown in FIG. 6. This reduces the distance between the first end of the link member 50 at the body film hinge 98 and the second end of the link member 50 at the lid film hinge 76. The reduction in the distance between the two ends of the link member 50 results in compressive forces being imposed on the link member 50 which cause the link member 50 to be deflected or bowed downwardly as best seen in FIG. 6. At this point, the compression link member 50 is maximally deformed at the over center position as shown in FIG. 6.

On either side of the over center position (FIG. 6), deformation of the link member 50 is at least partly reduced, and the lid 40 is thus urged to a stable position at the end of its travel range on that side of the over center position. In this manner, when the lid 40 is closed, it is self-maintained in the closed position. On the other hand, when the lid 40 is opened just past the over center position shown in FIG. 6, the compression link member 50 will cause the trunnion 70 and lid 40 to be rotated further beyond the over center point (in the clockwise direction illustrated in FIG. 7), and this will carry the film hinge 76 further away from the body film hinge 98 to thereby increase the distance between the two film hinges and urge the lid 40 to the fully open position shown in FIG. 7.

In the fully open position, the stress on the link member 50 is substantially eliminated, and it returns to a substantially planar orientation. The distance between the film hinges 98 and 76 in the fully open position is substantially the same as the distance between the film hinges 98 and 76 in the fully closed position. Thus, in the fully open position of the lid 40, each trunnion 70 is positioned in a bearing cavity 60 with a clearance $X_1$ on the front side and with a clearance $X_2$ on the rear side in the same manner as when the lid 40 is in the fully closed position. The clearances around the trunnions 70 insure that the compression link member 50 cannot be subjected to any significant compression stresses.

The novel structural configuration of the closure 10 of the present invention provides clearances around the trunnions in the fully open and fully closed positions which are sufficient to accommodate normal manufacturing or molding tolerances. Thus, if the trunnions 70 are made larger or smaller and/or if the bearing cavities 60 are made slightly larger or smaller —but within the design tolerances—the compression link member 50 will still not be subjected to significant compression stresses when the lid 40 is in the fully closed or fully opened position.

Figure 8:
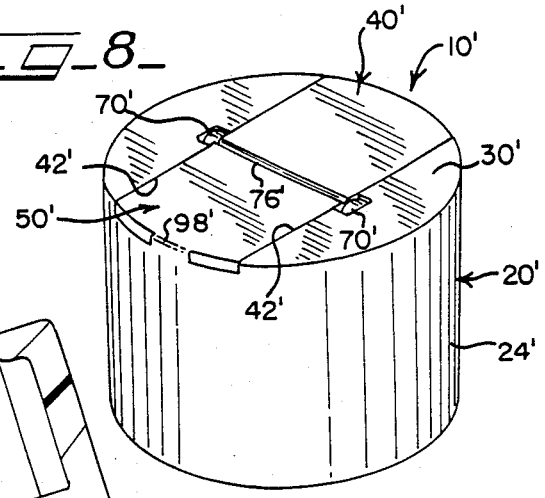
FIG. 8 is a perspective view of a second embodiment of the closure of the present invention shown in the fully closed position.
Figure 9:
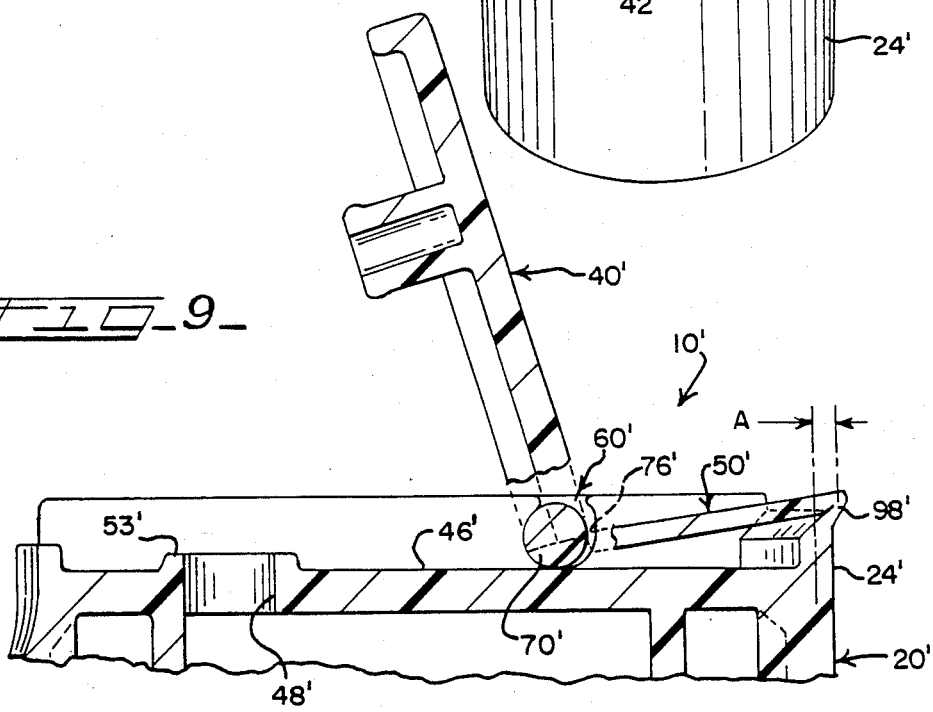
FIG. 9 is a greatly enlarged, fragmentary, cross-sectional view of a second embodiment of the closure shown in FIG. 8 with interior portions of the structure broken away to better illustrate interior detail and with the lid shown moved to the over center point.
Figure 10:
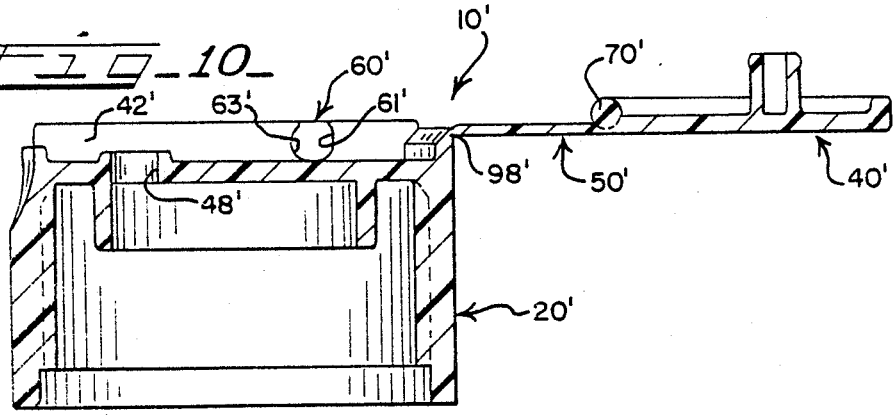
FIG. 10 is a view similar to FIG. 9, but in reduced scale, showing the second embodiment of the closure in an inoperative orientation in which the closure can be molded and in which the closure can be cleaned.

A second embodiment of the closure of the present invention is illustrated in FIGS. 8–10 wherein the closure is designated generally by the reference numeral 10'. The second embodiment of the closure 10' is similar to the first embodiment of the closure 10 described above with reference to FIGS. 1–7.

The closure 10' includes a closure body 20' having a cylindrical skirt 24'. The closure body 20' also includes a top wall 30' from which depend a pair of opposed side walls 42' defining a recess for receiving a compression link member 50' and lid 40' which are pivotally connected together with a film hinge 76'. A horizontal wall 46' defines the bottom of the recess and includes a dispensing aperture 48' surrounded by a short collar or spout 53'.

The lid 40' includes a pair of laterally projecting trunnions 70' which are received in bearing cavities 60' defined in the top wall 30' of the closure body 20'. Each trunnion 70' is generally cylindrical, and each bearing cavity 60' is open upwardly for receiving a trunnion 70'. The rear side of each bearing cavity 60' has a substantially vertical straight portion 61', and the front side of each bearing cavity 60' has a partially cylindrical front side portion 63'. The opening at the top of each bearing cavity 60' has a reduced width which is less than the diameter of each trunnion 70'. However, the portion of the closure body 20' adjacent the opening of each bearing cavity 63' is sufficiently resilient so that a trunnion 70' can be snapped through the opening into or out of the bearing cavity 60'.

The widest horizontal dimension of each bearing cavity 60' is greater than the diameter of each trunnion 70' so that clearance is provided on the front side and on the back side of each trunnion 70' when the trunnions 70' are disposed within the bearing cavities 60' while the lid 40' is in the fully closed or fully open positions.

The connection of the link member 50' to the closure body 20' differs from the connection structure for the analogous components in first embodiment of the closure 10 discussed above with reference to FIGS. 1–7. In particular, the link member 50' does not include any end surfaces, such as end surfaces 104 on the link member 50 of the first embodiment illustrated in FIGS. 1–7. Further, the closure body 20' does not include any abutment walls, such as the abutment walls 102 provided in the first embodiment of the closure 10 illustrated in FIGS. 1–7. Rather, the link member 50' extends rearwardly all the way to the exterior of the closure body cylindrical skirt 24' as best illustrated in FIG. 8. A small, central film hinge 98' connects the rear end of the link member 50' to the closure body skirt 24'.

As the lid 40' is opened toward the over center point (FIG. 9) the lid film hinge connection 76 moves in the clockwise direction causing the trunnions 70' to pivot forwardly against the front sides of the bearing cavities 60'. Further opening of the lid 40' results in compressive loading of the link member 50' as the front end of the link member 50' is moved rearwardly. The link member 50' is sufficiently rigid in this embodiment so that it deflects or bows downwardly only a small amount, if at all. Instead, the rearward movement of the link member 50' is accommodated by the rearward stretching of the film hinge 98' and by the upper portion of the closure body side wall 24' being deflected rearwardly by an amount A as shown in FIG. 9. The stretching of the film hinge 98' and the deflection of the peripheral wall 24' provides the spring force for the snap-action operation of the closure lid 40'.

When the lid 40' is opened further, past the over center point illustrated in FIG. 9, the film hinge 76' is moved clockwise away from the film hinge 98', and the resilient spring forces of the deflected wall 24' and film hinge 98' (which is under tension) urge the link member 50' to drive the film hinge 76' further in the clockwise direction to move the lid 40' to the fully open position. At that point, the distance between the film hinges 98' and 76' would be substantially the same as the distance between those hinges in the fully closed position (FIG. 8). Thus, approximately the same amount of clearance on both the front and rear sides of the trunnions 70' would exist in both the fully open and fully closed positions. This provides a closure that can accommodate various manufacturing and molding tolerances while still insuring that the compression link member 50' is substantially unstressed in the fully closed and fully open positions.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A unitary dispensing closure for use on a container defining an opening communicating with the container interior, said closure comprising:

a body for being mounted to said container over said container opening and defining a dispensing orifice for communicating through said container opening with said container interior, said body defining a pair of spaced-apart bearing cavities;

a lid including a pair of trunnions for each being received in one of said bearing cavities and defining an axis of rotation about which said lid can be pivoted through a range of movement defining at one end a fully closed position occluding said dispensing orifice and defining at the other end a full open position spaced away from said dispensing orifice;

a compression link member having first and second ends with said first end connected to said body and said second end pivotally connected to said lid at a location spaced from said trunnion axis, said compression link member is subjected to maximum stress when said lid is at an over center point between said fully open and fully closed positions; and said bearing cavities being larger than said trunnions and located relative to the length of said compression link member to provide clearance at least on opposite sides of each said trunnion when said compression link member is in said fully open position and in said fully closed position wherein said compression link member is substantially unstressed.

2. The closure in accordance with claim 1 in which said trunnions are cylindrical;

said bearing cavities each have at least a circular arc front surface facing toward said link first end and a circular arc rear surface facing away said link first end; and each said trunnion in one of said bearing cavities is spaced from said one bearing cavity front and rear surfaces when said lid is in said fully closed position and when said lid is in said fully open position.

3. The closure in accordance with claim 2 in which each said bearing cavity is defined in said body by a partially cylindrical surface extending greater than 180 degrees but less than 360 degrees around said trunnion axis to provide an opening to said cavity having a width less than the diameter of one of said trunnions; and said body adjacent said opening being sufficiently resilient so that said trunnion can be snapped through said opening into or out of said bearing cavity.

4. The closure in accordance with claim 1 in which said first end of said compression link member is pivotally connected to said body.

5. The closure in accordance with claim 4 in which said closure is formed of a thermoplastic material; and said first end of said compression link member is pivotally connected t said body with a flexible film hinge.

6. The closure in accordance with claim 5 in which said body defines a recess for receiving said compression link member;

said body defines a pair of upstanding, spaced-apart abutment walls defining a portion of said recess on either side of said film hinge; and said compression link member has a pair of spaced-apart end surfaces on either side of said film hinge for engaging said abutment walls and imposing thrust loads thereon when said lid is moved between said fully open and fully closed positions.

7. The closure in accordance with claim 6 in which said body has a generally cylindrical configuration;

each said abutment wall has an arcuate configuration at the periphery of said body; and each said compression link member end surface has an arcuate configuration substantially corresponding to the arcuate configuration of one of said abutment walls.

8. The closure in accordance with claim 1 in which said closure is formed of a thermoplastic material;

said compression link member has a generally planar top surface;

said lid has a generally planar top surface;

each said trunnion is cylindrical and is tangent to the planes of said top surfaces; and said second end of said compression link member is pivotally connected to said lid with a flexible film hinge along an axis at said planar top surfaces.

9. The closure in accordance with claim 8 in which said axis of rotation defined by said cylindrical trunnions is parallel to the axis defined by said film hinge at said second end of said compression link member.

10. The closure in accordance with claim 9 in which said first end of said compression link member is pivotally connected to said body with a film hinge along an axis parallel to said lid axis of rotation defined by said trunnions.

11. A unitary dispensing closure for use on a container defining an opening communicating with the container interior, said closure comprising:

a body for being mounted to said container over said container opening and defining a dispensing orifice for communicating through said container opening with said container interior, said body defining a pair of spaced-apart bearing cavities;

a lid including a pair of trunnions for each being received in one of said bearing cavities and defining an axis of rotation about which said lid can be pivoted through a range of movement defining at one end a fully closed position occluding said dispensing orifice and defining at the other end a fully open position spaced away from said dispensing orifice;

a compression link member having first and second ends with said first end pivotally connected to said body and said second end pivotally connected to said lid at a location spaced from said trunnion axis, said compression link member having a length such that it is subjected to maximum stress when said lid is between said fully open and fully closed positions at an over center point at which said compression link member second end lies between, and n a plane defined by, said trunnion axis and said compression link member first end pivot connection; and said bearing cavities being larger than said trunnions and located relative to the length of said compression link member to provide clearance at lest on opposite sides of each said trunnion when said compression link member is in said fully open position and in said fully closed position wherein said compression link member is substantially unstressed.

12. The closure in accordance with claim 11 in which said closure is formed of a thermoplastic material;

said compression link member has a generally planar top surface;

said lid has a generally planar top surface; and when said lid is in said fully closed position, said compression link member first and second pivot connections and said top surfaces of said compression link member and said lid are all generally coplanar.

13. A unitary dispensing closure for use on a container defining an opening communicating with the container interior, said closure comprising:

a body for being mounted to said container over said container opening and defining a dispensing orifice for communicating through said container opening with said container interior, said body defining a pair of spaced-apart bearing cavities and an upstanding rear wall portion resiliently flexible away from said bearing cavities along a deflection region on said body;

a lid including a pair of trunnions of each being received in one of said bearing cavities and defining an axis of rotation about which said lid can be pivoted through a range of movement defining at one end a fully closed position occluding said dispensing orifice and defining at the other end a fully open position spaced away from said dispensing orifice;

a compression link member having first and second ends with said first end connected to said body and said second end pivotally connected to said lid at a location spaced from said trunnion axis, said compression link member having a length such that it is subjected to maximum stress when said lid is between said fully open and fully closed positions at an over center point at which said compression link member second end lies between, and on a plane defined by, said trunnion axis and said rear wall deflection region; and said bearing cavities being larger than said trunnions and located relative to the length of said compression link member to provide clearance at least on opposite sides of each trunnion when said compression link member is in said fully open position and in said full closed position wherein said compression link member is substantially unstressed.

14. The closure in accordance with claim 13 in which said closure is formed of a thermoplastic material; and said upstanding rear wall portion has a generally arcuate configuration.

15. The closure in accordance with claim 13 in which each said bearing cavity is open upwardly in said body; and said body is sufficiently resilient adjacent each said opening so that one of said trunnions can be snapped through one of said openings into or out of said bearing cavity.

* * * * *

UNITED STATES PATENT AND TRADEMARK OFFICE

CERTIFICATE OF CORRECTION

PATENT NO. : 4,911,337

DATED : March 27, 1990

INVENTOR(S) : Karl-Heinz Rosenthal

It is certified that error appears in the above-identified patent and that said Letters Patent is hereby corrected as shown below:

Column 8, line 28, the phrase --having a length such that it-- should be inserted after the word "member"

Signed and Sealed this

Eighteenth Day of June, 1991

*Attest:*

*Attesting Officer*

HARRY F. MANBECK, JR.

*Commissioner of Patents and Trademarks*